United States Patent [19]

Terada

[11] 4,426,176

[45] Jan. 17, 1984

[54] L-SHAPED CONCRETE BLOCK AND METHOD FOR CONSTRUCTING A RETAINING WALL BY SUCH L-SHAPED CONCRETE BLOCKS

[75] Inventor: Kinji Terada, Kitakyushu, Japan

[73] Assignee: Tokuyama Soda Co., Ltd., Tokyo, Japan

[21] Appl. No.: 291,658

[22] Filed: Aug. 10, 1981

[51] Int. Cl.[3] ..... E02D 29/02

[52] U.S. Cl. ..... 405/285; 52/610; 405/286

[58] Field of Search ..... 405/284, 285, 286; 52/592, 610; 405/31, 258

[56] References Cited

U.S. PATENT DOCUMENTS

| | | | |
|---|---|---|---|
| 982,697 | 1/1911 | Upson | 405/286 |
| 1,467,470 | 9/1923 | Borg | 405/286 X |
| 3,269,125 | 8/1966 | Moore | 405/286 X |
| 4,067,166 | 1/1978 | Sheahan | 52/610 X |

*Primary Examiner*—David H. Corbin

*Attorney, Agent, or Firm*—Jordan and Hamburg

[57] ABSTRACT

A block of this invention for constructing a retaining wall is characterized by having a front wall portion of a rectangular shape, a rear retaining portion extending rearwardly and perpendicularly from the front wall portion and a gnarl-like uniting portion integrally formed at the distal end of the rear retaining portion. The block is further provided with vertical elongated holes through which reinforcing bars pass at least at a position where the front wall portion and the rear retaining portion merge and in the gnarl-like uniting portion. Due to such construction, when the blocks are stacked up in rows and the soil for land creation is charged in the spaces, each of which is defined by the front wall portion, the rear retaining portions and the gnarl-like uniting portion to form a retaining wall, such retaining wall can show increased integrity and stability against earthquakes, vibrations or flood disasters.

4 Claims, 26 Drawing Figures

L-SHAPED CONCRETE BLOCK AND METHOD FOR CONSTRUCTING A RETAINING WALL BY SUCH L-SHAPED CONCRETE BLOCKS

BACKGROUND OF THE INVENTION

This invention relates to concrete blocks used for constructing readily and inexpensively a firm retaining wall structure available for the creation of bulkheads, in road or river construction or the preparation of housing sites.

Conventionally, retaining wall structures for the above purposes were mainly constructed by the "support method". However, the utilization of concrete blocks is considered not suitable for constructing the retaining wall in such method since the wall must withstand earthquakes, vibration or flood disaster while maintaining an almost upright or vertical front wall surface relative to the ground. Therefore, in general, at least the major part of the retaining wall has been constructed by an integral one-plate concrete structure, thus necessitating a costly construction.

Accordingly, it is an object of the present invention to provide L-shaped concrete blocks which can construct a retaining wall structure which can be firmly united with the created land, and thereby can sufficiently withstand earthquakes or flood disaster.

It is another object of the present invention to provide a method for efficiently constructing a retaining wall structure by such L-shaped concrete blocks.

In summary, the present invention discloses an L-shaped concrete block comprising a vertical front wall portion consisting of a rectangular plate, the front wall having at least one vertical elongated hole through which at least one reinforcing bar passes, a vertical rear retaining portion extending rearwardly and perpendicularly from the front wall portion, the rear retaining portion having the proximal end thereof integrally connected to the rear surface of the front wall portion at a position approximately one fourth from one end of the front wall portion, and a vertical gnarl-like uniting portion integrally formed at the distal end of the rear retaining portion, the gnarl-like uniting portion being provided with a vertical elongated hole through which a reinforcing bar passes.

The present invention also discloses a method for constructing a retaining wall by a plurality of L-shaped concrete blocks, comprising preparing a plurality of the L-shaped concrete blocks, each L-shaped concrete block comprising (i) a vertical front wall portion consisting of a rectangular plate, the front wall being provided with at least one vertical elongated hole through which a reinforcing bar passes, (ii) a vertical rear retaining portion extending rearwardly and perpendicularly from the front wall portion, the rear retaining portion, having the proximal end thereof integrally connected to the rear surface of the front wall portion at a position approximately one fourth from one side of the front wall portion, and (iii) a vertical gnarl-like uniting portion integrally formed at the distal end of the rear retaining portion, the gnarl-like uniting portion being provided with a vertical elongated hole through which a reinforcing bar passes, mounting a plurality of the vertical reinforcing bars firmly and at a predetermined pitch on a concrete foundation, arranging and stacking several rows of the L-shaped concrete blocks on the foundation by making the reinforcing bars pass through the vertical elongated holes of the L-shaped concrete blocks, the stacking being in a staggered pattern while alternately reversing the sides of the front wall portions of the L-shaped concrete blocks row after row, thus defining a vertical square space between each two vertical rear retaining portions, and filling the land-creating soil into the vertical square space and solidifying the soil after the filling.

DETAILED DESCRIPTION OF DISCLOSURE

Figure 1:
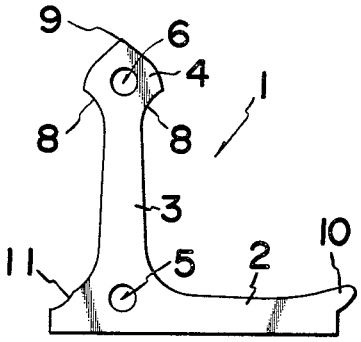
FIG. 1 is a plan view of an L-shaped concrete block of this invention.
Figure 2:
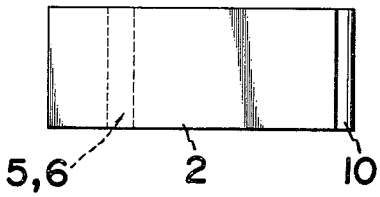
FIG. 2 is a front view of the block.
Figure 3:
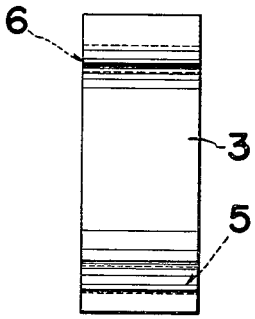
FIG. 3 is a side view of the block.
Figure 4B:
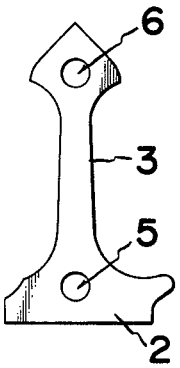
FIG. 4*a* and FIG. 4*b* are plan views of spacer blocks.
Figure 4A:
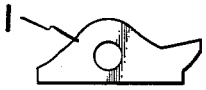
Figure 5A:
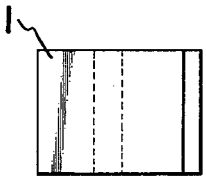
FIG. 5*a* and FIG. 5*b* are front views of the blocks.
Figure 5B:
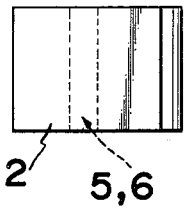

The L-shaped concrete block for constructing a retaining wall of the present invention is hereinafter disclosed in detail in conjunction with the attached drawings.

In the drawings, numeral 1 indicates an L-shaped concrete block preferably provided with reinforcing ribs therein. The block 1 substantially comprises a vertical front wall portion 2 having a rectangular-plate-like shape, a vertical rear retaining portion 3 which extends rearwardly and perpendicularly from the front wall portion 2 and a vertical gnarl-like uniting portion 4 which is formed at the distal end of the vertical rear retaining portion 3. In the above construction, the vertical front wall portion 2 may preferably be provided with a rectangular brim on the front surface thereof for an ornamental purpose. The rear retaining portion 2 has the proximal end thereof integrally connected to the rear surface of the front wall portion 2 at a position approximately one fourth in from one side of the front wall portion 2, thus forming an L-shaped configuration along with the vertical front wall portion 2.

Figure 8:
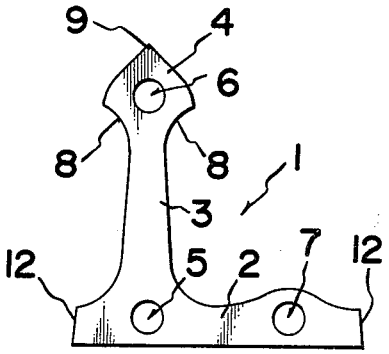
FIG. 8 is a plan view of an L-shaped concrete block of a first modification.
Figure 10:
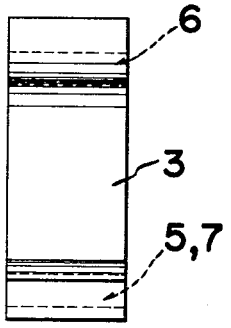
FIG. 10 is a side view of the block.
Figure 9:
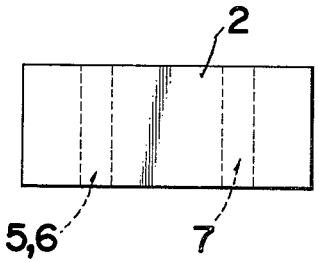
FIG. 9 is a front view of the block.

The gnarl-like uniting portion 4 has a spade-like shape comprising a sharp peak end 9 and a pair of symmetrical slippage resisting surfaces 8, wherein the sharp peak end 9 promotes the smooth and firm extension of the gnarl-like uniting portion 4 into the created land along with the rear retaining portion 3, while the slippage resisting surfaces 8 prevent the separation of the gnarl-like uniting portions 8 from created land in a direction toward the front wall portion 2. The L-shaped concrete block 1 of this invention is also provided with a plurality of vertical elongated holes 5, 6 and 7 through which vertical reinforcing bars 13 pass, wherein a first vertical elongated hole 5 is formed in the front wall portion 2 at a position where the rear retaining portion 3 abuts the front wall portion 2, a second vertical elongated hole 6 is formed in the gnarl-like uniting portion 4, and a third vertical elongated hole 7 may be, as shown in FIG. 8 and FIG. 10, formed in the front wall portion 2 at a position laterally symmetrical to the position where the first vertical elongated hole 5 is formed. The L-shaped concrete block 1 of this invention is further provided with a protrusion 10 and a recess 11 at respective lateral sides of the front wall portion 2. However, when the third vertical elongated hole 7 is formed in the front wall portion 2, the elements 10, 11 may not be necessary and sides 12 provided on the front wall portion 2 as shown in FIG. 8 and FIG. 10.

Figure 7:
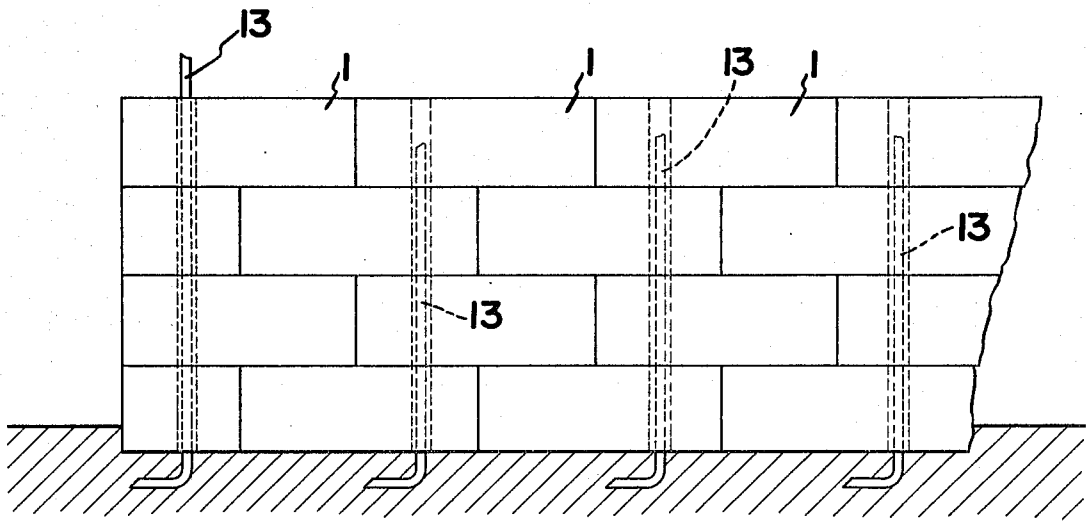
FIG. 7 is a front view of the retaining wall structure.
Figure 11:
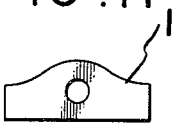
FIG. 11 is a plan view of a spacer block of a first modification.
Figure 12:
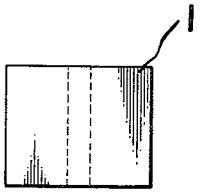
FIG. 12 is a front view of the block.
Figure 14:
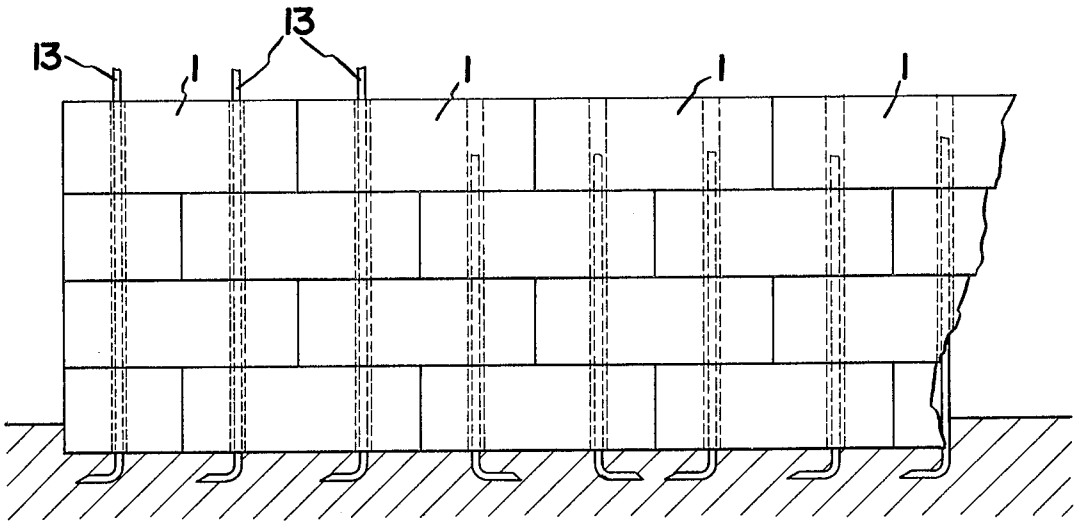
FIG. 14 is a front view of the retaining wall structure.
Figure 15:
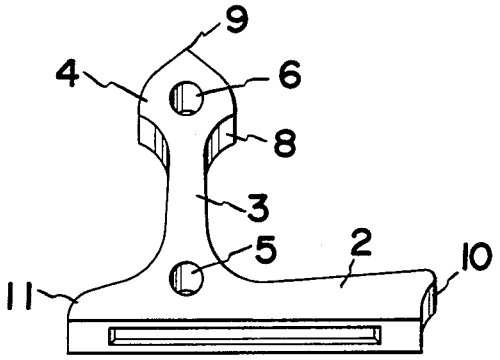
FIG. 15 is a plan view of an L-shaped concrete block of a second modification.
Figure 17:
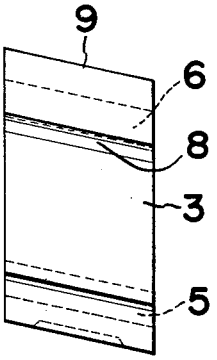
FIG. 17 is a side view of the block.
Figure 16:
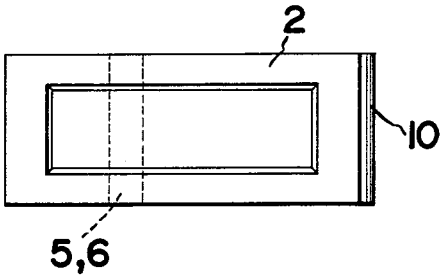
FIG. 16 is a front view of the block.
Figure 18:
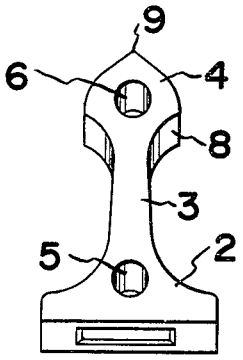
FIG. 18 is a plan view of a spacer block of this modification.
Figure 20:
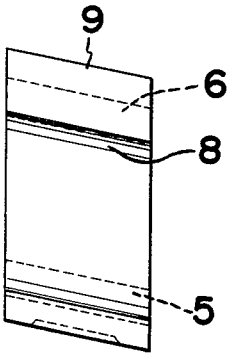
FIG. 20 is a side view of the spacer block.
Figure 19:
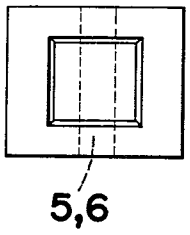
FIG. 19 is a front view of the spacer block.
Figure 21:
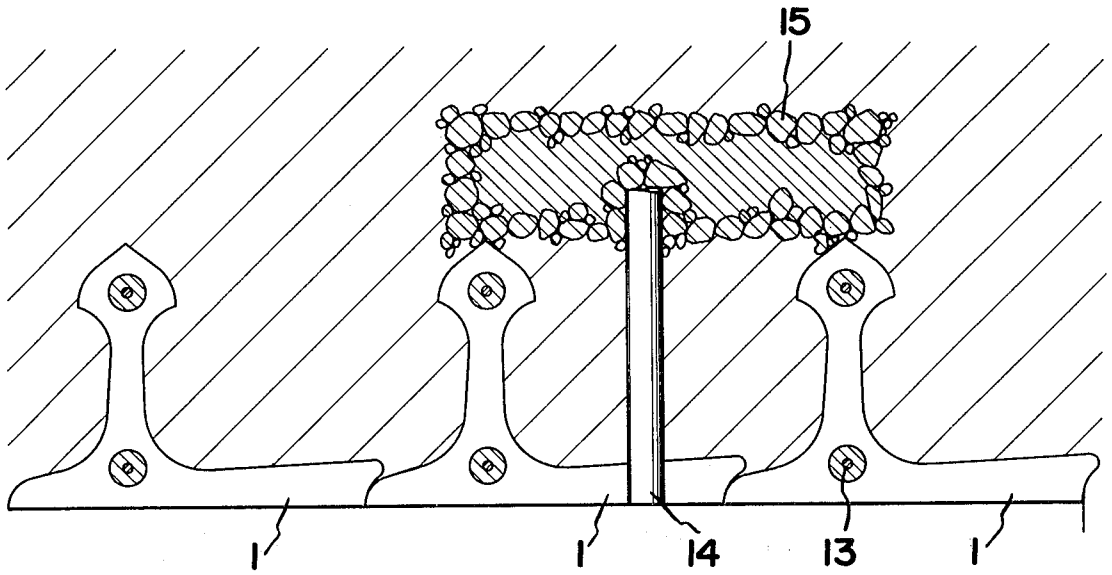
FIG. 21 is a plan view of a retaining wall structure constructed by the above-mentioned blocks.
Figure 22:
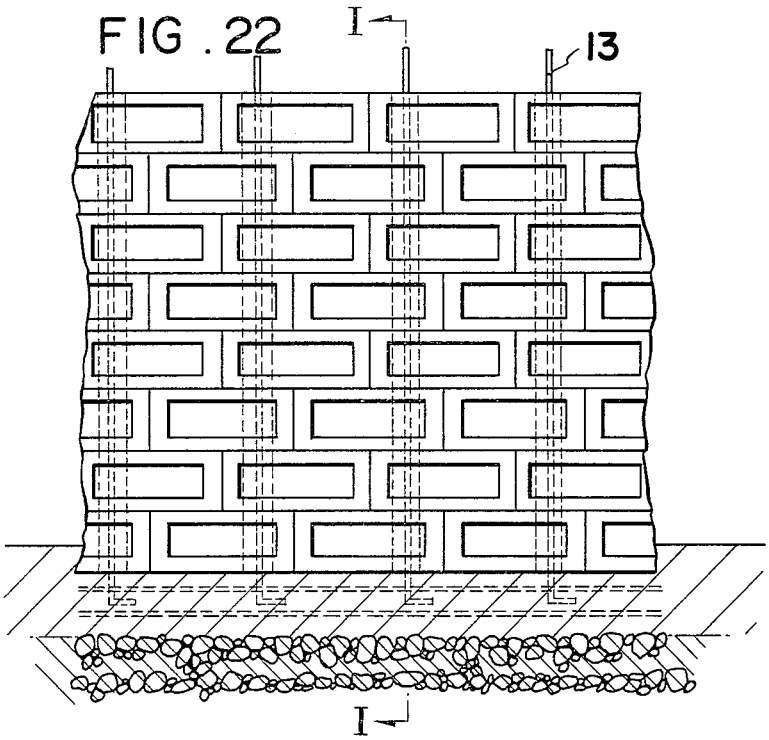
FIG. 22 is a front view of the retaining wall structure.
Figure 23:
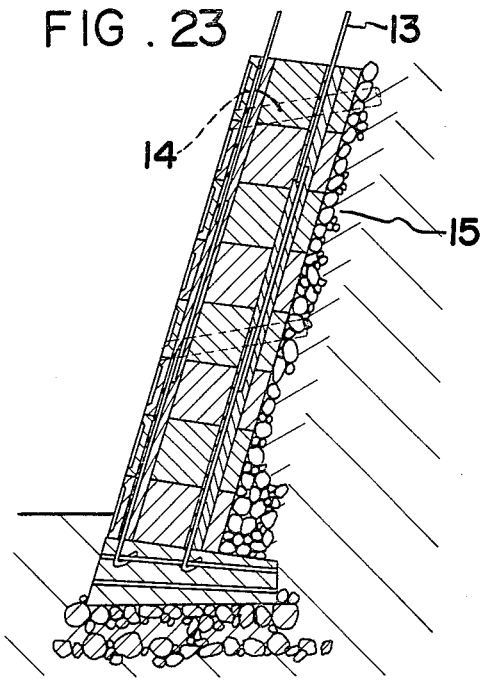
FIG. 23 is a cross-sectional view of the retaining wall structure taken along the line I—I of FIG. 22.

Blocks shown in FIG. 4*a*, FIG. 4*b*, FIG. 5*a*, FIG. 5*b* are spacer blocks used for constructing a retaining wall structure shown in FIG. 7, while blocks shown in FIG. 11 and FIG. 12 are spacer blocks used for constructing a retaining wall structure shown in FIG. 14.

The L-shaped concrete block 1 may preferably has a weight of approximately more than 200 kg per block. The front wall portion 2 may preferably have the width thereof about 2.5 to 3 times greater than the height thereof, while the length of the rear retaining portion 3 including the gnarl-like uniting portion 4 should preferably be substantially equal to the width of the front wall portion 2. Of course, it is possible to prolong or shorten the length of the rear retaining portion 3 relative to the width of the front wall portion 2. It is also preferable to make the volume of the gnarl-like uniting portion 4 substantially equal to the proximal end of the rear retaining portion.

Figure 6:
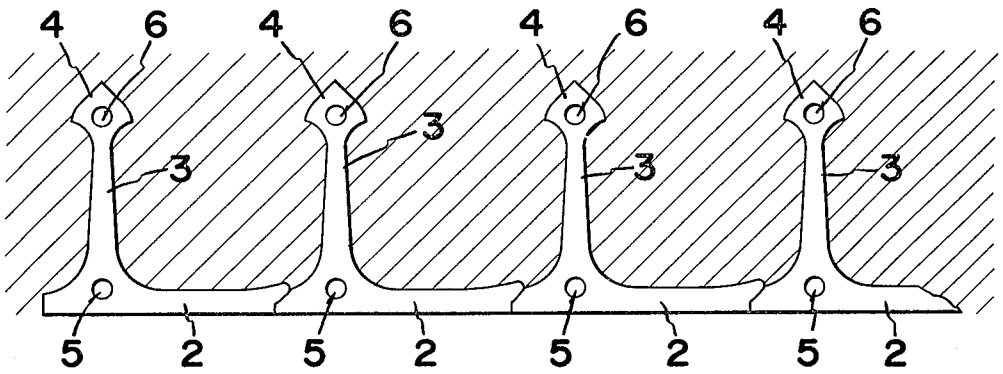
FIG. 6 is a plan view of a retaining wall structure constructed by the above blocks.

The manner in which the retaining wall structure according to this invention is constructed by the above-mentioned L-shaped blocks is described hereinafter in conjunction with the embodiment shown in the attached drawings FIG. 6 and FIG. 7.

In this embodiment, the L-shaped block used had the following particulars:

(1) block height: 50 cm (2) width of front wall portion: 125 cm (3) thickness of front wall portion and rear retaining portion: 13 cm (4) diameter and the total weight of embedded reinforcing ribs: 9 $\phi$ mm$\times$about 5 kg (5) weight per block: about 380 kg Such blocks 1 were employed for constructing a retaining wall structure of a vertical upright front wall necessary for the expansion of the width of a local road by 2 m.

First of all, the ground on which the retaining wall is to be constructed was levelled. Subsequently, a concrete base or foundation having the desired thickness was formed. Simultaneous with the above base forming operation, a desired number of vertical elongated reinforcing bars 13 were stood on the foundation in a predetermined lateral pitch by embedding the lower ends of the reinforcing bars 13 in the foundation. It is needless to say that these reinforcing bars 13 were arranged such that they came into alignment with the vertical elongated holes 5, 6 formed in the L-shaped concrete blocks 1 of this invention. Then the first (lowest) row of the L-shaped concrete blocks 1 were placed on the foundation by making the reinforcing bars 13 pass through the elongated vertical holes 5, 6 while engaging the protrusions 10 of the front wall portions 2 with the recess 11 of the neighboring front wall portions 2.

Slurry like concrete was fed into the vertical elongated holes 5, 6 so as to firmly and integrally unite all the L-shaped concrete blocks 1 of the first row. A few days later, after the concrete was completely solidified, the soil for road creation was charged into each space defined by the front wall portion 2, the rear retaining portions 3 and the gnarl-like uniting portion 4 while assuring necessary drainage.

It is preferable to supply water into the charged soil after the soil charging operation to increase the density of the soil thereby promoting the uniting of the rear retaining portion 3 and the gnarl-like uniting portion 4 with the charged soil. However, if water is not available, the entire upper surface of the charged soil may be stamped by any suitable stamping device.

Subsequently, the second row of L-shaped concrete blocks 1 was stacked on the first row by passing the reinforcing bars 13 through the vertical elongated holes 5, 6 of the L-shaped concrete blocks wherein the L-shaped concrete blocks of the second row have the sides of the front wall portions 2 reversed relative to the sides of the front wall portions 2 of the L-shaped concrete blocks of the first row. However, in this staggered stacking operation, the rear retaining portion 3, the gnarl-like uniting portion 4 and the elongated vertical holes 5, 6 of L-shaped concrete blocks of the second row all came into vertical alignment with those of the L-shaped concrete blocks of the first row. Thereby a space defined by the front wall portion 2, the rear retaining portion 3 and the gnarl-like uniting portion 4 of the blocks of the second row could communicate with the above mentioned space defined by the corresponding elements of the blocks of the first row. After the stacking operation, slurry-like concrete was fed into the vertical elongated holes 5, 6 of the blocks 1 of the second row, subsequently the soil for road creation was fed into the spaces of the second row, and finally the charged soil was solidified by a suitable means.

In this manner, several rows of L-shaped concrete blocks were stacked in a staggered pattern until the retaining wall obtained the desired wall height. Suitable ballast or gravel was provided on the uppermost surface of the charged soil. Then a road roller having a considerable weight was driven on the gravel or ballast so as to further promote the solidification of the charged soil and the uniting of the rear retaining column (consisting of the plurality of rear retaining portions) and of the gnarl-like uniting column (consisting of the plurality of gnarl-like uniting portions) with the solidified charged soil. Finally, the pavement was provided on the gravel or ballast, thus completing the road creating operation.

Although the retaining wall discussed heretofore has an upright vertical front face, such retaining wall will have stability so long as the height of the retaining wall falls within 1.6 times of the length of the rear retaining portion 3 and the gnarl-like portion 4. Accordingly, when the ratio between the above height and the length exceeds the above value, it is preferable to impart a slight incline to the retaining wall to increase the stability of the retaining wall.

Figure 13:
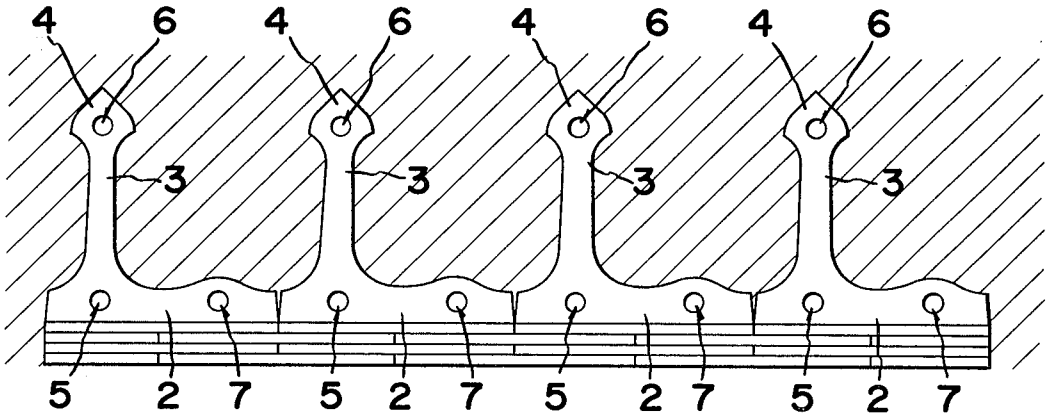
FIG. 13 is a plan view of a retaining wall structure constructed by the above blocks.

In FIG. 13 and FIG. 14, a first modification of the L-shaped concrete blocks 1 is disclosed.

The modification is substantially characterized by replacing the protrusion 10 and the recess 11 of the front wall portion 2 with the vertical elongated hole 7 formed in the front wall portion at a position symmetrical to the position of the vertical elongated hole 5. Due to such provision 7, the L-shaped concrete blocks arranged and stacked in rows can be firmly united horizontally as well as vertically thus providing a firm retaining wall structure.

A second modification is shown in FIG. 15 to FIG. 23, wherein the improvement is characterized in that the vertical front wall portion 2, the vertical rear retaining portion 3, the vertical gnarl-like uniting portion 4 and the vertical elongated holes 5, 6 all have a predetermined incline by making upper ends thereof inclined rearwardly. The L-shaped concrete blocks of this modification are especially useful in constructing a retaining wall having a desired incline. In the drawings, numeral 14 indicates a drainage conduit and numeral 15 indicates gravel for drainage.

Figure 24:
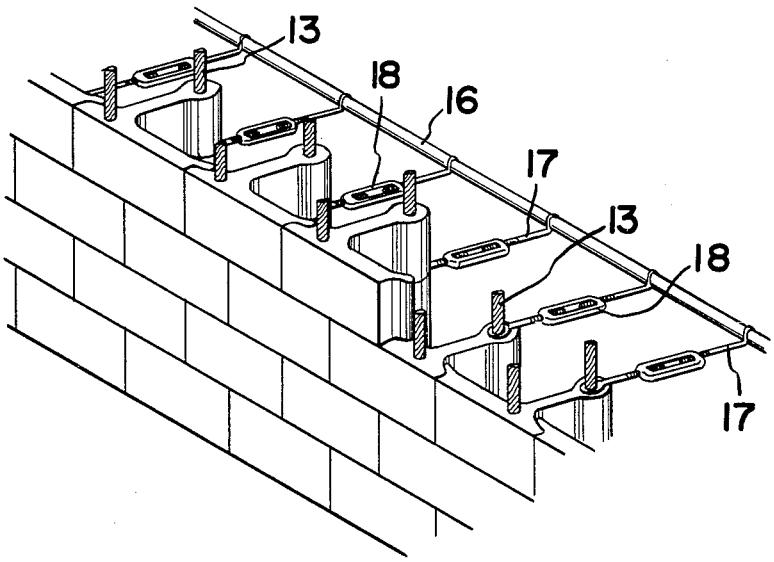
FIG. 24 is a schematic view of a retaining wall structure of a third modification.

A third modification is shown in FIG. 24, wherein the improvement is characterized in that the retaining wall structure disclosed heretofore is further reinforced by the provision of an elongated horizontal pile 16 placed underground. Such pile 16 is disposed parallel to and at the rear of the stacked L-shaped blocks 1 and is tightly connected with vertical elongated reinforcing bars 13 which pass through the vertical elongated holes 5, 6 of the L-shaped concrete blocks by means of tension bolts 17 and turnbuckles 18.

What we claim is:

1. Method for constructing a retaining wall by a plurality of L-shaped concrete blocks, comprising (1) preparing a plurality of said L-shaped concrete blocks, said each L-shaped concrete block comprising (i) a vertical front wall portion consisting of of a rectangular plate, said front wall being provided with at least one vertical elongated hole through which a reinforcing bar passes, (ii) a vertical rear retaining portion extending rearwardly and perpendicularly from said front wall portion, said rear retaining portion having the proximal end thereof integrally connected to the rear surface of said front wall portion at a position approximately one fourth the distance from one side of said front wall portion, and (iii) a vertical enlarged gnarl-like uniting portion integrally formed at the distal end of said rear retaining portion, said enlarged uniting portion being provided with a vertical elongated hole through which a reinforcing bar is adapted to pass, (2) mounting a plurality of said reinforcing bars firmly and in a parallel spaced apart manner on a concrete foundation, (3) arranging and stacking a plurality of rows of said L-shaped concrete blocks on said foundation by passing said reinforcing bars through said vertical elongated holes of said L-shaped concrete blocks, said stacking being in a staggered pattern while alternately reversing the sides of said front wall portions of said L-shaped concrete blocks row after row, thus defining a vertical square space between each two vertical rear retaining portions, and (4) filling soil into said vertical square spaces and solidifying said soil after said filling.

2. Method for constructing a retaining wall by a plurality of L-shaped concrete blocks, comprising (1) preparing a plurality of said L-shaped concrete blocks, said each L-shaped concrete blocks comprising (i) a vertical front wall portion consisting of a rectangular plate, said front wall being provided with at least one vertical elongated hole through which a reinforcing bar passes, (ii) a vertical rear retaining portion extending rearwardly and perpendicularly from said front wall portion, said rear retaining portion having the proximal end thereof integrally connected to the rear surface of said front wall portion at a position approximately one fourth the distance from one end of said front wall portion, and (iii) a vertical enlarged gnarl-like uniting portion integrally formed at the distal end of said rear retaining portion, said enlarged uniting portion being provided with a vertical elongated hole through which a reinforcing bar is adapted to pass, (2) mounting a plurality of said reinforcing bars firmly and in a parallel spaced apart manner on a concrete foundation, (3) arranging and stacking several rows of said L-shaped concrete blocks on said foundation by passing said reinforcing bars through said vertical elongated holes of said L-shaped concrete blocks, said stacking being in a staggered pattern while alternately reversing the sides of said front wall portions of said L-shaped concrete blocks row after row, thus defining a vertical square space between each two vertical rear retaining portions, (4) filling soil into said vertical square spaces and solidifying said soil after said filling, (5) placing an elongated horizontal pile underground, said pile being disposed parallel to and at the rear of said stacked L-shaped blocks, and (6) tightly connecting said pile and said vertical elongated reinforcing bars disposed in said vertical elongated holes.

3. An L-shaped concrete block integrally formed as one piece, said block having a front wall portion integrally joined to a rear retaining portion, said front wall portion having a generally rectangular configuration and adapted to be vertically disposed with two vertical sides, a vertical elongated hole in said front wall portion adapted to receive a reinforcing bar to facilitate mounting a like L-shaped concrete block thereon, said rear retaining portion extending generally perpendicularly from said front wall portion at a position on said front wall portion spaced from one vertical side of said front wall portion, the distance between said position and said one vertical side of said front wall portion being approximately one-fourth the distance between said two vertical sides, said front wall portion and said rear retaining portion each being of the same height, said retaining portion having an integrally-formed terminating end portion formed as a gnarl-like enlargement extending the same height as the height of said rear retaining portion, and a vertical elongated hole in said enlargement adapted to receive a reinforcing bar to facilitate mounting a like L-shaped concrete block thereon.

4. An L-shaped concrete block integrally formed as one piece, said block having a front wall portion integrally joined to a rear retaining portion, said front wall portion having a generally rectangular configuration with two sides along with a top surface and a bottom surface, an elongated hole in said front wall portion adapted to receive a reinforcing bar to facilitate mounting a like L-shaped concrete block thereon, said rear retaining portion extending generally perpendicularly from said front wall portion at a position on said front wall portion spaced from one side of said front wall portion, the distance between said position and said one side of said front wall portion being approximately one-fourth the distance between said two sides, said front wall portion and said rear retaining portion each being of the same height, said retaining portion having an integrally-formed terminating end portion formed as a gnarl-like enlargement extending the same height as the height of said rear retaining portion, and an elongated hole in said enlargement adapted to receive a reinforcing bar to facilitate mounting a like L-shaped concrete block thereon, said top surface being generally parallel to said bottom surface and being adapted to be horizontally disposed when said L-shaped block is positioned for use, said front wall portion, said rear retaining portion, and said elongated holes all being disposed at an acute angle relative to said top and bottom surfaces.

* * * * *